United States Patent [19]

Keithahn et al.

[11] 4,444,250

[45] Apr. 24, 1984

[54] FLOW DIVERTER

[75] Inventors: Julian D. Keithahn, Houston; Charles D. Morrill; Joseph R. Roche, both of Humble, all of Tex.

[73] Assignee: Hydril Company, Los Angeles, Calif.

[21] Appl. No.: 449,375

[22] Filed: Dec. 13, 1982

[51] Int. Cl.[3] ..... E21B 33/06

[52] U.S. Cl. ..... 166/84; 251/1 A; 137/869

[58] Field of Search ..... 166/84, 86, 87, 88, 166/53, 363, 374; 251/1 A, 1 R, 1 B, 63; 137/862, 869

[56] References Cited

U.S. PATENT DOCUMENTS

| | | | |
|---|---|---|---|
| 1,027,344 | 5/1912 | Lally | 137/556.6 |
| 1,455,731 | 5/1923 | Kelly | 251/1 R X |
| 1,467,877 | 9/1923 | Rea | 166/84 |
| 1,944,840 | 1/1934 | Humason | 166/87 |
| 2,231,221 | 2/1941 | Rector | 251/1 R X |
| 2,484,622 | 10/1949 | Hartman | 137/869 X |
| 2,609,836 | 9/1952 | Knox | 277/73 |
| 2,911,997 | 11/1959 | Schramm et al. | 166/87 X |
| 3,791,442 | 2/1974 | Watkins | 166/352 |
| 4,071,085 | 1/1978 | Grable et al. | 166/84 |
| 4,192,376 | 3/1980 | Lissmyr | 166/87 X |
| 4,378,849 | 4/1983 | Wilks | 251/1 R X |

*Primary Examiner*—Ernest R. Purser
*Assistant Examiner*—Michael Starinsky
*Attorney, Agent, or Firm*—Dodge & Bush

[57] ABSTRACT

Flow diverter apparatus is disclosed having a housing and a piston and annular packer disposed therein. The diverter has passages in the piston and housing walls providing fluid communication between the borehole and a vent line. A valve in the vent line is opened before the packer of the apparatus is closed about a tubular member in the bore of the apparatus or completely closes the vertical flow path of the bore of the apparatus when no object is therein, thereby diverting pressurized borehole fluid away from the rig equipment and personnel.

5 Claims, 4 Drawing Figures

FLOW DIVERTER

BACKGROUND OF THE INVENTION

1. Field of the Invention

The invention relates to oil well flow diverter apparatus and systems. In particular the invention is directed to apparatus for diverting well bore flow safely away from an oil rig where unbalanced well bore pressure in the annulus between the well bore and a drill string causes the flow rate to exceed a safe rate through the rig mud piping and control system.

2. Description of the Prior Art

When drilling an oil well, an initial large diameter bore is drilled to shallow depths. Protective drive or conductor pipe, typically thirty (30) inches in diameter, is secured in the shallow bore through which the drilling takes place. For offshore floating drilling a subsea riser extends from the drilling rig to the well-head at the sea floor. Flow diverters are typically provided below the rig floor and between the conductor pipe and the rotary table of the drilling rig. A flow diverter provides a means for controlling "kicks" of low pressure formation gas accumulations in the fluid of the subsea riser encountered in top hole drilling.

Prior diverter systems have been primarily of two types: the first includes a flow diverter assembly requiring different diameter packing inserts to accommodate different diameter tubular members; the second includes an annular blowout preventer placed above a vent line in which a valve is disposed to open when the annular blowout preventer is closed about the drill pipe or other object in the well bore in response to a "kick" in the annulus of the borehole.

In the first type of flow diverters, packer elements must be changed for different sized tubulars in the bore and are in general unable to close the borehole when no tubular is in the borehole to close about.

In the second type system the combined height of the annular blowout preventer and of the side outlets of the vent line below the annular blowout preventer may require excessive headroom under the rig floor. The combined height may be a disadvantage where rigs have limited height and transfer capabilities, because the assembled blowout preventer/side outlet assembly is advantageously moved and lowered through the rig rotary table in position below the rig floor.

An advantageous feature of the flow diverter apparatus to be described below is that while it provides apparatus that can pack about tubular or other goods in the well bore of varying diameters (or even completely close the well bore where no object is in the well bore) it also eliminates the need for vent line placement below the diverter apparatus.

SUMMARY OF THE INVENTION

The invention relates to a flow diverter for directing pressurized well bore fluid away from a drilling rig fluid system to prevent danger to equipment and personnel. In line with the marine riser or conductor pipe, a housing with an annular packing element and piston disposed therein is provided in which passages are provided in the piston and housing walls to allow fluid communication between the borehole and outlets in the housing wall. A vent line is provided to transport pressurized drilling fluid away from the rig when borehole fluid of excess pressure is present and the annular packing element is closed. A valve in the vent line, closed during normal drilling operations, opens simultaneously with the closing of the annular packing element. The vent line directs the pressurized fluid to a land pit, or overboard on an offshore drilling rig.

BRIEF DESCRIPTION OF THE DRAWINGS

In the drawings wherein like numerals indicate like parts and wherein an illustrative embodiment of this invention is shown.

DESCRIPTION OF THE INVENTION

Figure 1:
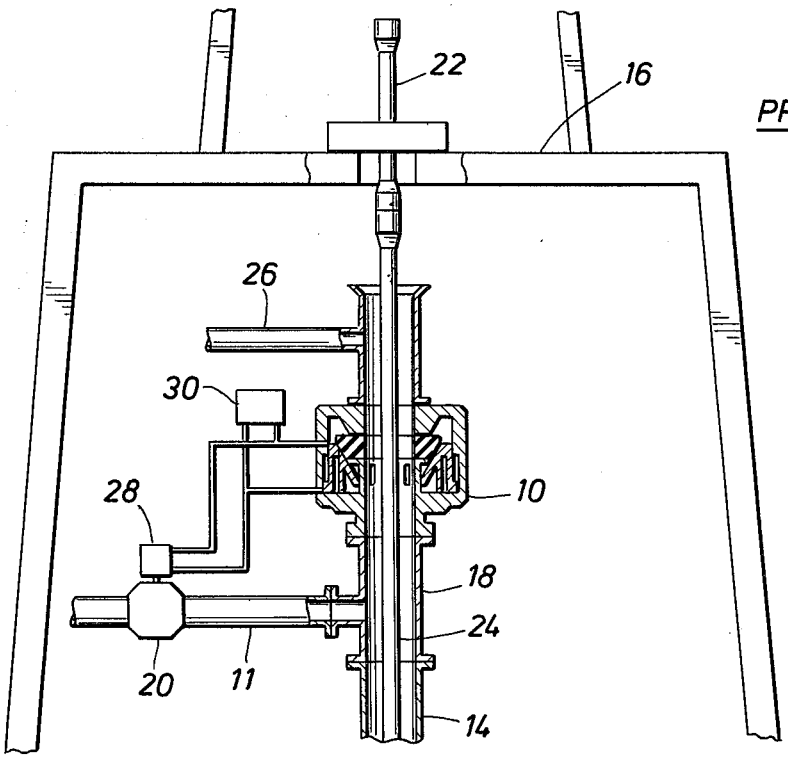
FIG. 1 PRIOR ART
FIG. 1 illustrates a prior art flow diverter system in which an annular blowout preventer is placed above a vent line above a conventional conductor pipe.

FIG. 1 illustrates a prior art installation of an annular blowout preventer 10 used as a diverter in conjunction with a vent or "blowdown" line 11 and valve 20 for use during the drilling of the shallow portion of an oil or gas well. The purpose of the diverter apparatus is to divert pressurized flow in the annulus between the conductor conduit 14 and drill pipe 24 away from the rig and its personnel.

The annular blowout preventer 10 is attached directly to the conduit 14 below the rig floor 16. One or more vent lines 11 are connected directly below the annular blowout preventer 10 and are sized to prevent excessive well bore back pressure buildup. A drilling spool 18 is provided to connect the vent line 11 and the annular blowout preventer 10 to conductor pipe 14. A kelly 22 is shown connected to drill pipe 24 either of which may extend through the bore of the annular blowout preventer 10.

Flow line 26 provides normal return flow of drilling fluid which is pumped through the kelly 22 through drill pipe 24 to the drilling bit and up the annulus between the borehole or conductor pipe and the drill pipe 24. Flow line 26 empties into a mud tank, shale shaker, etc. to complete the drilling fluid circuit.

Valve 20 has typically been provided as a full opening valve and is controlled via switch 28 which applies opening pressure to valve 20 as closing pressure is applied to blowout preventer 10. Operating pressure for the valves is provided by means of accumulator unit 30.

Figure 2:
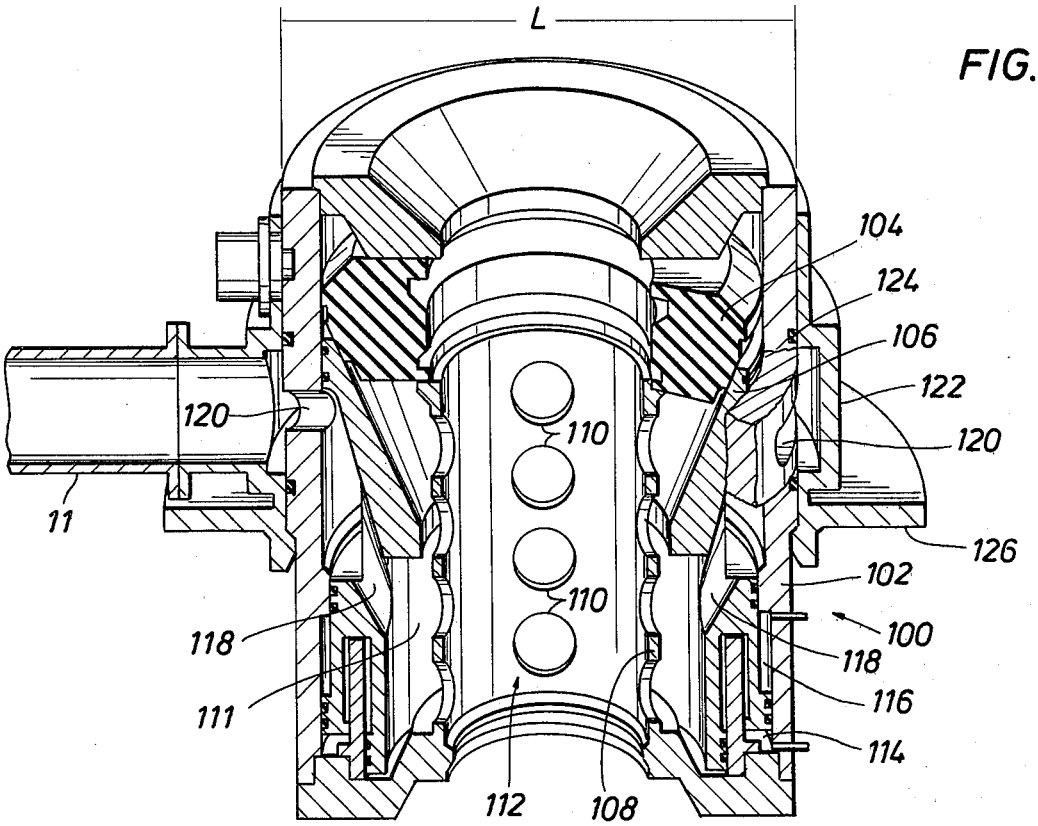
FIG. 2 illustrates flow diverter apparatus according to the invention having passages for fluid communication from the borehole to outlet holes in the housing wall.

FIG. 2 illustrates the flow diverter apparatus 100 according to the invention. Cylindrical housing 102 is provided for packing element 104 and piston 106. Cylindrical tube 108 is connected to housing 102 and has openings 110 for fluidcommunication between the bore 112 in diverter apparatus and the annulus 111 between the housing 102 and tube 108. Closing chamber 114 is provided for application of pressurized control fluid in order to urge piston 106 upwardly thereby closing packing element 104 about tubular or other objects 24 in the opening 112 or for completely closing off the bore 112. Opening chamber 116 is provided to return piston 106 to its normal position and to open packing element 104.

Passages 118 are provided in piston wall 106 for providing fluid communication of the borehole fluid in the annular space between the housing 102 and tube 108. The passages 118 terminate in outlet holes 120 which advantageously are oblong in shape so as to reduce as much as possible the vertical dimension of the flow diverter apparatus 100. Cover 122 about housing wall 102 provides a fluid passageway from outlet hole 120 to vent line 11. Dimension L is provided for the housing of the diverter 100 so that it may be conveniently lowered through the opening of the rotary table to cover mounting framework 126 and attached cover 122 and vent line 11 which are preferably previously mounted below the drilling rig floor. Seals 124 are disposed in grooves about the housing wall for preventing fluid from leaking about the housing wall of the flow diverter apparatus.

Figure 3:
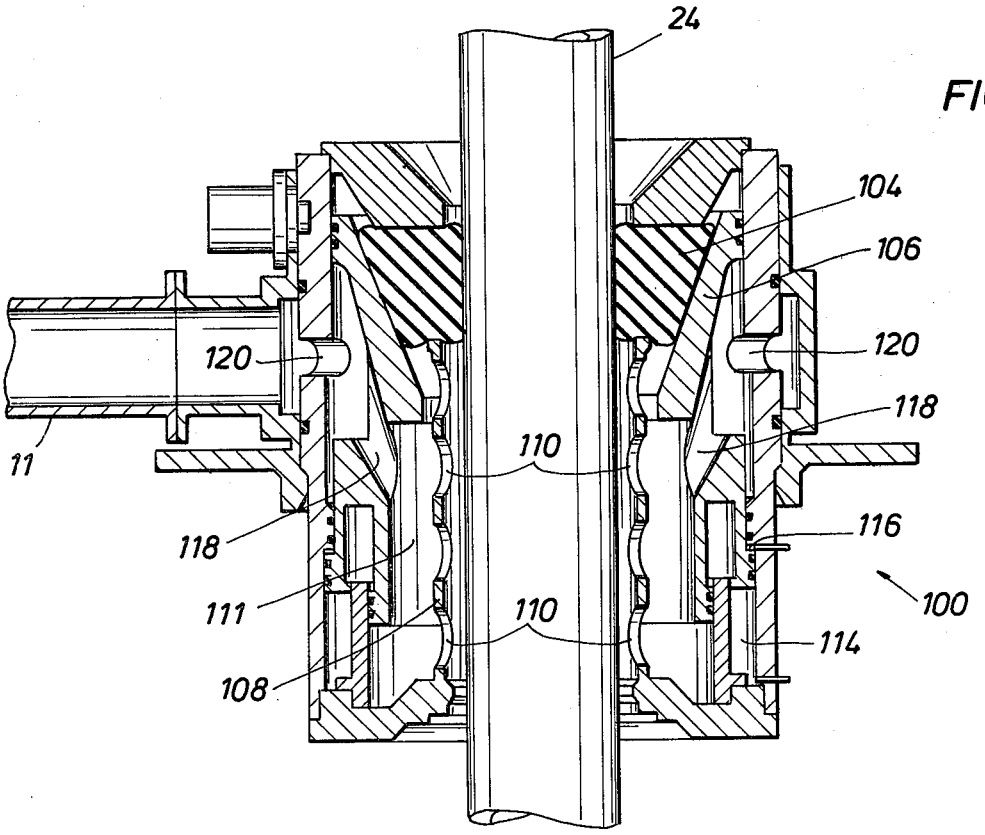
FIG. 3 illustrates the flow diverter apparatus of FIG. 2 in a closed position having its packing element closed about a tubular member in the borehole.

FIG. 3 illustrates flow diverter apparatus 100 where piston 106 has been urged upwardly thereby causing packing element 104 to seal about tubular member 24. Borehole fluid is in communication with holes 120 via passages 118.

Figure 4:
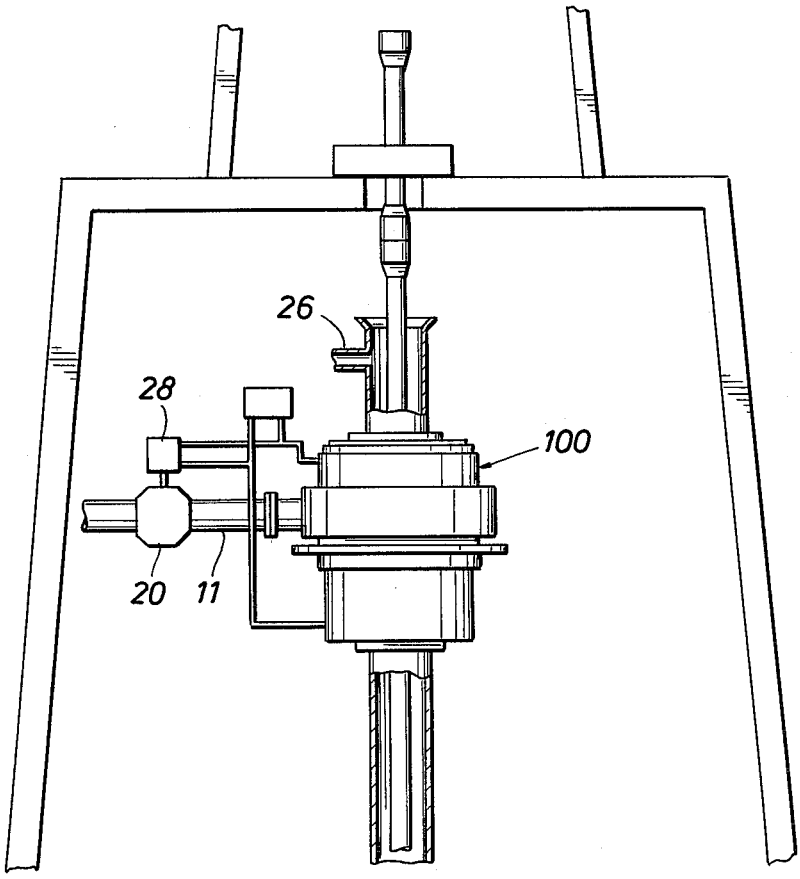
FIG. 4 illustrates the flow diverter apparatus of FIG. 2 with a vent line and valve connected to the outlet holes in its housing.

FIG. 4 illustrates the flow diverter apparatus 100 connected to valve 20. Switch 28 opens valve 20 as hydraulic fluid is applied to diverter 100 for closing the packing element.

Thus, there has been provided according to the invention, flow diverter apparatus which is shorter in vertical height than that of the prior art. Advantageously, the flow diverter according to the invention enjoys compactness of installation with an annular packing element which is adapted to close not only on any tubular in the borehole but also on open hole.

Various modifications and alterations in the described structures will be apparent to those skilled in the art of the foregoing description which do not depart from the spirit of the invention. For this reason, these changes are desired to be included in the appended claims. The appended claims recite the only limitations of the present invention and the descriptive manner which is employed for setting forth the present embodiment and is to be interpreted as illustrative and not limitative.

What is claimed is:

1. Apparatus for directing pressurized well bore fluid of a well bore away from a drilling rig comprising, a cylindrical housing having one or more outlet passages provided in its wall, a packer in the housing having an annulus of resilient material;

a packer-actuating piston in fluid communication with the borehole within the housing and engaged with the packer and actuatable to apply radially inwardly directed force to the packer for sealing with a pipe or other object in the well bore or to close same in the absence of any object in the well bore, the piston having one or more passages for fluid communication between the borehole and the outlet passage provided in the housing wall, and flow line means connected to said housing for diverting fluid from said housing outlet passage away from the borehole.

2. Apparatus for directing pressurized well bore fluid of a well bore away from a drilling rig comprising, a cylindrical housing having one or more outlet passages provided in its wall, a packer in the housing having an annulus of resilient material;

cylindrical tube means disposed coaxially within the housing and having openings for providing fluid communication between the fluid in the well bore and the annulus between the tube means and the housing, a packer-actuating piston disposed in the annulus between the tube means and the housing and engaged with the packer and actuatable to apply radially inwardly directed pressure to the packer for sealing with a pipe or other object in the well bore or to close same in the absence of any object in the well bore, the piston having one or more passages for fluid communication between the fluid in the tube means/housing annulus and the outlet passage provided in the housing wall, and flow line means connected to said housing for diverting fluid from said housing outlet passage away from the borehole.

3. The flow diverter of claim 1 or 2 wherein said outlet passages in the cylindrical housing terminate in outlet holes in the wall of the housing, the holes being oblong.

4. The apparatus of claim 1 or 2 wherein said flow line means comprises a flow line connected to said housing outlet passage, and valve means in said flow line operable for opening said flow line before borehole fluid pressure exceeds an unsafe limit.

5. Apparatus adapted for use as a flow diverter for directing pressurized well bore fluid of a well bore away from a drilling rig via a diverter vent line, comprising a cylindrical housing having one or more outlet passages provided in its wall, the outlet passages connected for fluid communication with the diverter vent line, a packer in the housing having an annulus of resilient material, a packer-actuating piston in fluid communication with the borehole within the housing and engaged with the packer and actuatable to apply radially inwardly directed pressure to the packer for sealing with a pipe or other object in the well bore or for closing the well bore in the absence of any object in the well bore, the piston having one or more passages for fluid communication between the borehole and the outlet passage provided in the housing wall.

* * * * *